US005829359A

United States Patent [19]

Dohr et al.

[11] Patent Number: 5,829,359

[45] Date of Patent: Nov. 3, 1998

[54] RAILWAY HOPPER CAR DISCHARGE GATE ASSEMBLY

[75] Inventors: Jeremy J. Dohr, Kenosha; Brian A. Senn, South Milwaukee; Robert S. Toms, Jr., Racine, all of Wis.; Robert T. Fischer, Homewood, Ill.

[73] Assignee: Miner Enterprises, Inc., Geneva, Ill.

[21] Appl. No.: 710,224

[22] Filed: Sep. 13, 1996

[51] Int. Cl.[6] ..... B61D 7/24

[52] U.S. Cl. ..... 105/310; 105/282.3; 105/305; 105/311.2

[58] Field of Search ..... 105/282.1, 282.3, 105/286, 287, 288, 289, 305, 308.1, 310, 310.1, 311.1, 311.2

[56] References Cited

U.S. PATENT DOCUMENTS

| | | | |
|---|---|---|---|
| 1,080,280 | 12/1913 | Hult . | |
| 1,083,563 | 1/1914 | Sage . | |
| 1,499,735 | 7/1924 | Hynes . | |
| 1,924,419 | 8/1933 | Sinden . | |
| 2,142,236 | 1/1939 | Campbell . | |
| 2,644,408 | 7/1953 | Dorey . | |
| 2,749,770 | 6/1956 | Dorey . | |
| 3,110,270 | 11/1963 | Ingram . | |
| 3,248,026 | 4/1966 | Kemp . | |
| 3,316,859 | 5/1967 | Floehr . | |
| 3,344,748 | 10/1967 | Dorey . | |
| 3,387,570 | 6/1968 | Pulcrano et al. . | |
| 3,415,204 | 12/1968 | Pase . | |
| 3,682,105 | 8/1972 | Marulic . | |
| 3,683,820 | 8/1972 | Floehr . | |
| 3,709,152 | 1/1973 | Gutridge . | |
| 3,710,729 | 1/1973 | Schuller . | |
| 3,837,294 | 9/1974 | Fossett . | |
| 3,893,398 | 7/1975 | Fischer . | |
| 3,933,100 | 1/1976 | Dugge . | |
| 3,956,966 | 5/1976 | Fischer . | |
| 4,094,254 | 6/1978 | Koranda | 105/282.3 |
| 4,228,696 | 10/1980 | Jablonsky . | |
| 4,253,400 | 3/1981 | Fischer et al. . | |
| 4,256,042 | 3/1981 | Fischer . | |
| 4,262,603 | 4/1981 | Morse . | |
| 4,301,741 | 11/1981 | Chierici . | |
| 4,342,267 | 8/1982 | Blout . | |
| 4,534,298 | 8/1985 | Scott . | |
| 4,843,974 | 7/1989 | Ritter et al. . | |
| 5,046,432 | 9/1991 | Bowler . | |
| 5,272,987 | 12/1993 | Lucas | 105/308.1 |
| 5,353,713 | 10/1994 | Dohr et al. | 105/310 |
| 5,448,955 | 9/1995 | Dugge et al. | 105/305 |
| 5,507,235 | 4/1996 | Dugge et al. | 282/3 |
| 5,584,251 | 12/1996 | Lucas | 105/305 |

OTHER PUBLICATIONS

Miner Enterprises Inc. AutoLOK™ discharge gate displayed at RSA show, 1992.

"Specification for New Gravity Outlet Gates on Covered Hopper Cars, Standard S–233–92 (AAR S–233–92)," Association of American Railroads, Mechanical Division, *Manual of Standards and Recommnded Practices,* pp. C11–C13.4 (Sep. 1, 1992).

One–sheet multi–colored drawing labeled "Keystone Gate".

*Primary Examiner*—S. Joseph Morano
*Attorney, Agent, or Firm*—John W. Harbst

[57] ABSTRACT

A discharge gate assembly for a railway hopper car that satisfies the new AAR requirements and specifications and includes a frame defining a generally rectangular discharge opening with a gate slidably mounted on the frame for endwise horizontal movement between opened and closed positions. An operating shaft assembly is supported on opposite frame extensions for rotational movement about a fixed axis. The operating shaft assembly is operably coupled to the gate. A lock assembly is operably coupled to the operating shaft assembly and includes a vertically displacable stop member mounted for vertical and rotational movement about a fixed axis extending above the path of movement of the gate and in fore-and-aft relationship relative to an edge of the gate. When the gate is in its closed position, the stop member extends downwardly and into engagement with the gate edge to positively prevent the gate from substantial movement toward an open position. A drive mechanism is disposed adjacent the frame extensions for positively displacing the stop member from the path of travel of the gate in timed relation relative to movement of the gate toward an open position.

40 Claims, 6 Drawing Sheets

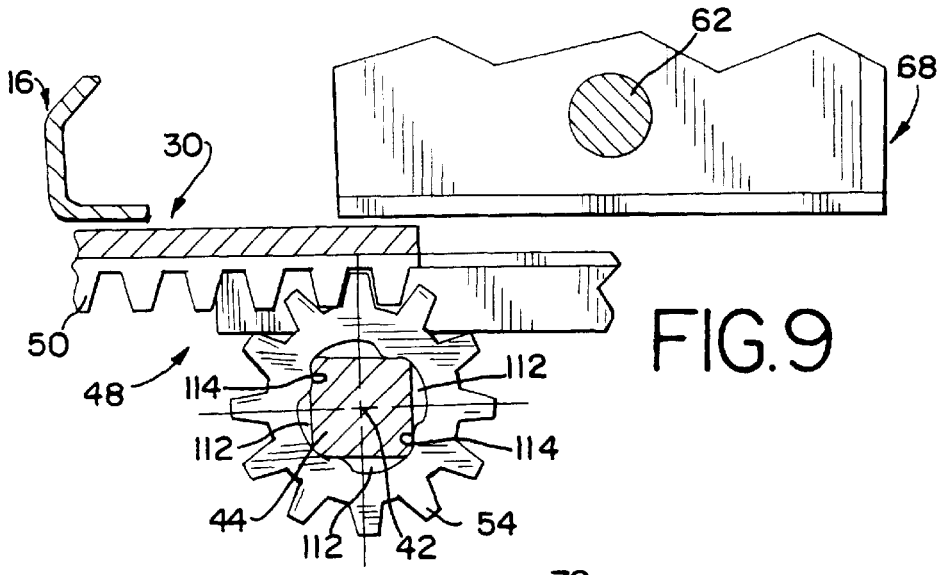
FIG.9
FIG.10
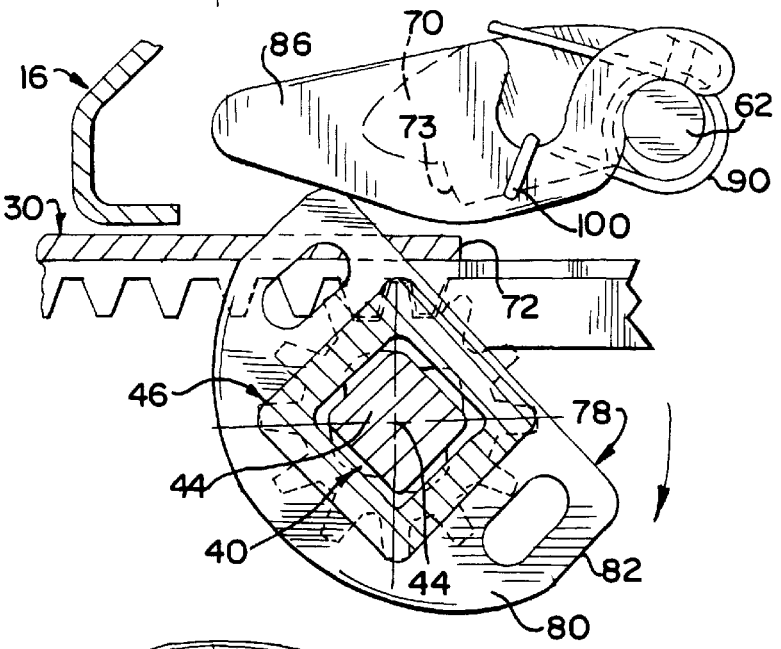
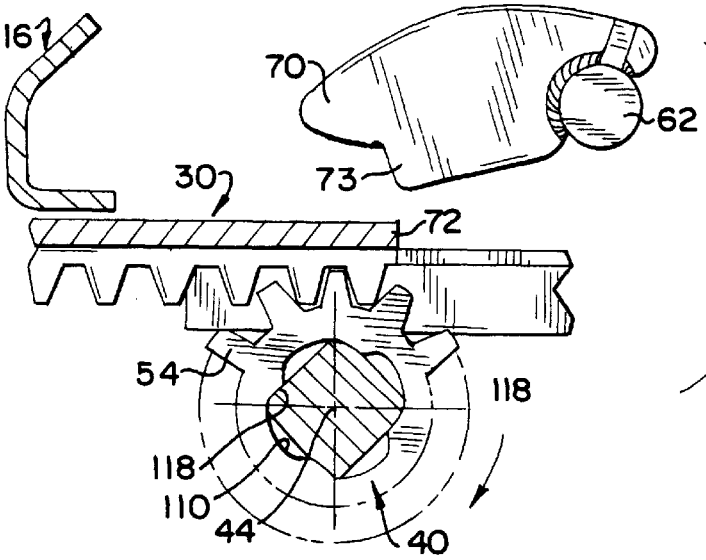
FIG.11

RAILWAY HOPPER CAR DISCHARGE GATE ASSEMBLY

FIELD OF THE INVENTION

The present invention generally relates to discharge gate assemblies for railway hopper cars and, more particularly, to a gravity discharge gate assembly which meets current American Association of Railways (AAR) regulations.

BACKGROUND OF THE INVENTION

Railway hopper cars typically include one or more discharge openings through which lading or ballast within the car is discharged by gravity. A discharge gate assembly including a frame is fitted to the hopper car and defines a discharge opening through which the lading or ballast in the car is exhausted. A gate is slidably mounted on the frame for movement between open and closed positions to control the discharge of lading or ballast from the hopper car. The gate is typically moved between positions through a rack and pinion system, including at least one rack row welded to an underside of the gate and at least one pinion which is operated by an operating shaft assembly rotatably mounted on the frame of the gate assembly.

As will be appreciated, it is important to prevent inadvertent opening of the gate. Railway cars are subjected, however, to numerous impact forces, some of which can be quite severe. When a railway car moves down a hump in a classification yard, it likely will impact with other cars on the same track. A filled railway car weighs tons and has a tendency to gather substantial momentum as it moves along the track. Thus, the impact with a stationary railway car to which it is to be coupled can be exceeding forceful. While shock absorbers are built into the coupling units on the cars, severe shock loads remain within the body of the car and its contents. Such loads can affect the position of the gate. Of course, if a partially opened gate is not recognized, a substantial amount lading or ballast can gravitationally pass through the gate as the cars move from one shipping location to another.

Accordingly, each gate assembly on the car is typically provided with some form of locking mechanism for holding the gate in a closed position. The heretofore known locking mechanisms for holding the gate closed have a myriad of designs. Basically, however, such locking mechanisms include some form of mechanical locking members which are effective to lock the gate in a closed position, but they require manual opening and manual closing to be effective.

For several reasons, the heretofore known manually operated mechanisms are constantly being destroyed when the gates are opened. The operating condition of the locking mechanism is often overlooked when lading is to be discharged from the hopper car. Alternatively, the manually operated locking mechanisms are initially opened prior to the rail car reaching a ballast or lading discharge station. Between the time the locking mechanism is initially opened and the time the railway car reaches the discharge station, the car may be impacted with other cars once or several times. Occasionally, the shock loads of impacting cars can return the locking mechanism to a closed or locked condition. Limited visual access, inconvenient physical access, human error and the increasing demand to quickly unload the rail cars all contribute to the manually operated locking mechanisms being either substantially damaged or completely destroyed. Moreover, high-powered torque drivers are often used to open the gates and result in inadvertent destruction of the locking mechanism.

The American Association of Railways (AAR) has recently promulgated new regulations dealing with or addressing gravity discharge gate assemblies in operation. The new AAR standard is S-233-92 and relates to issues involving hopper railway car outlet discharge gates, installation, the level of forces sustainable by the locks prior to inadvertent opening, seals and myriad of related matters.

As mentioned above, filled railway hopper cars are designed to transport tons of lading or ballast. Accordingly, and although there may be multiple discharge gate assemblies arranged on a hopper car, the gate or door of each discharge gate assembly is subjected to extreme downward loading conditions. Besides being subjected to extreme loading, the lading being transported may be cement or other form of relatively fine granular material. As will be appreciated, residue of such fine material often passes about and around the edges of the door or gate of each discharge gate assembly. When subjected to moisture during the course of its travel, such residue material, when combined with such moisture, can cause significant problems involving sliding or opening of the gate at the discharge station.

Due to the extreme loading conditions and residue material interfering with operation of the gate assembly, substantially increased torque is required to be applied to the rack and pinion system to open the gate. The level of such torque is such that a portion of the operating shaft assembly is often displaced under the influence of such torque levels. Displacement of the operating shaft assembly adversely affects performance and timing of the rack and pinion system thus resulting in significant operational problems.

Various discharge gate assemblies have been proposed wherein a pivotal locking member extends over and hooks a distal end of the gate. Such lock designs, however, have also proven undesirable. Testing has revealed that when the rail cars impact against each other, that portion of the lock hooking the edge of the gate tends to pivot or raise upwardly thus losing or lessening the locking efficiency on the gate. When the impact between the cars is sufficient, the hook or lock tends to inadvertently open thus allowing the door or gate of the discharge gate assembly to slidably move from its normally closed position thus resulting in loss of lading or ballast from the car. As mentioned above, if a partially open gate is not recognized, a substantial amount of lading can gravitationally pass through the partially opened gate as the cars move from one shipping location to another without detection.

Thus, there is a need and a desire for a railcar discharge gate assembly including a locking mechanism which satisfies the AAR standards and maintains the gate in a closed position and yet which automatically opens prior to movement of the gate toward an open position.

SUMMARY OF THE INVENTION

In view of the above, and in accordance with the present invention, there is provided a discharge gate assembly for a railway hopper car that satisfies the new AAR requirements and specifications. The discharge gate assembly of the present invention includes a frame defining a generally rectangular discharge opening with a gate slidably mounted on the frame for endwise horizontal movement between opened and closed positions along a predetermined path of movement. The gate is slidably mounted on the frame and acts as a valve for controlling discharge of ballast or lading from the railway hopper car to which the gate assembly is to be mounted. An operating shaft assembly is supported on the frame for rotational movement about a fixed axis. The operating shaft assembly is operably coupled to the gate.

According to the present invention, a lock assembly is arranged independent of while being operably coupled to the operating shaft assembly. The lock assembly includes a vertically displacable stop member mounted for vertical and rotational movement about a fixed axis extending above the path of movement of the gate and in fore-and-aft relationship relative to an edge of the gate. When the gate is in its closed position, the stop member extends downwardly and into engagement with the gate edge to positively prevent the gate from substantial movement toward an open position.

The stop member of the lock assembly is mounted upon a shaft extending generally parallel to and above an upper side of the gate. In a most preferred form of the invention, the lock assembly includes dual stop members arranged upon a rockshaft supported by the frame extension of the discharge gate assembly. Each stop member of the lock assembly is biased into engagement with the gate thus inhibiting inadvertent movement of the stop member upon impact loading the railway car. Mounting the stop member above the gate allows gravity to urge the stop members into engagement with the gate. In one form of the invention, a spring resiliently urges each stop member of the lock assembly into the path of movement of and preferably into engagement with a gate.

In a preferred form of the invention, the operating shaft assembly includes an elongated operating shaft rotatably supported on the frame by operating handles connected to opposite ends of the operating shaft. The operating shaft assembly is operably coupled to the gate through a rack and pinion system. The rack and pinion system includes a pair of laterally spaced pinion gears mounted on the operating shaft and which engage laterally spaced rows of racks welded otherwise affixed to an underside of the gate.

A drive mechanism is disposed adjacent the frame for positively operating the lock assembly. The drive mechanism for the lock assembly positively removes each stop member from the path of movement of the gate in response to rotation of the operating shaft assembly prior to movement of the gate toward an open position.

The drive mechanism of the lock assembly includes cam structure at opposite ends of the operating shaft assembly for positively displacing the stop member relative to the path of movement of the gate upon rotation of the operating shaft assembly. In a preferred form of the invention, the drive mechanism of the lock assembly further includes a follower at opposite ends of the rockshaft for engaging a periphery of the cam structure and thereby positively moving the stop member regardless of the torque input to the operating shaft assembly.

A lost motion mechanism is arranged between the operating shaft assembly and the gate for effecting sequential movement of the stop member and the gate in predetermined timed relation to each other. In a most preferred form of the invention, the lost motion mechanism is provided between the rack and pinion assembly of the operation shaft assembly. That is, in a most preferred form the invention the lost motion mechanism includes a slotted configuration on each of the pinions for allowing a predetermined range of rotation of the operating shaft prior to movement of the gate. The predetermined range of motion of the operating shaft assembly is from about 35° to about 55° of initial movement of the operating shaft assembly. In a most preferred form of the invention, the predetermined range of motion of the operating shaft assembly measures about 45° initial movement of the operating shaft assembly.

A major advantage of the present invention involves its simplistic operation. The advantage of mounting the stop members of the lock assembly in fore-and-aft spaced relation of the operating shaft assembly is that a positive locking feature is inherent in such a design because the locks inherently move into positive engagement with the gate. Mounting the stop members such that they angularly extend downwardly and into engagement with the door also enhances visibility of lock engagement and disengagement. Mounting the stop or lock members of the lock assembly in spaced relation from the edge of the door minimizes the distance separating the operating shaft assembly from the frame thus adding structural rigidity and integrity to the lock assembly. Mounting the stop members in fore-and-aft spaced relation relative to the door edge and such that the stop members extend downwardly toward and into positive engagement with the door edge allows minimization of gate overhang thereby realizing substantial cost and weight savings, while the fabrication of the gate assembly is also facilitated by present invention. Moreover, mounting the locks above the upper side of the gate advantageously reduces the likelihood that commodities will interfere with operation of the lock assembly.

It is important to note that the drive mechanism for the lock assembly is arranged adjacent the frame extensions of the gate assembly. Arranging the drive mechanism of the lock assembly adjacent the frame extensions advantageously allows an increased torque input to the operating shaft assembly without detrimental effects to lock operation. Moreover, mounting the drive mechanism adjacent the frame extensions permits an increase in throw or lock lift as compared to alternative designs. Importantly, mounting the drive assembly adjacent to the frame tends to reduce flexural forces and thus reduces tolerance dependency of the lock assembly.

A salient feature of the present invention involves the creation of a lock mechanism that forms a sub assembly which can be subsequently added to the frame assembly. The lock assembly of the present invention is simpler than previously known designs in that the addition of a separate actuating shaft on which the stop members are mounted and arranged in combination with the operating shaft assembly provides simplicity to manufacture and assemble. That is, rather than requiring the operating shaft assembly to perform all functions associated with the lock assembly, the present invention separates the operating shaft assembly from the drive mechanism of the lock assembly. Accordingly, the design of the present invention is significantly more tolerant of shaft deflection of the operating shaft assembly.

The cam followers of the lock assembly drive mechanism are specifically designed to allow a seal to be arranged in combination with the drive mechanism to provide a quick and ready visual reference regarding operation of the gate assembly. In a most preferred form of the invention, each cam follower of the lock assembly is specifically designed to prevent the car seal from being incorrectly arranged and prevents rail car seal tampering. The cam follower's specific design prevents binding between the cam follower and the cam structure when the door moves in either direction.

These and numerous other features and advantages of the present invention will become readily apparent from the following detailed description, the accompanying drawings, and the appended claims.

DESCRIPTION OF THE DRAWINGS

FIG. 9 is a side elevational view taken along line 9—9 of FIG. 1;

FIG. 10 is a fragmentary side elevational view of the lock assembly like FIG. 6 but showing an operating shaft assembly rotated to move a gate toward an open position;

FIG. 11 is a view similar to FIG. 5 but showing the relationship of certain component parts of the present invention when the operating shaft assembly is in the position shown in FIG. 10;

DETAILED DESCRIPTION OF THE INVENTION

Figure 1:
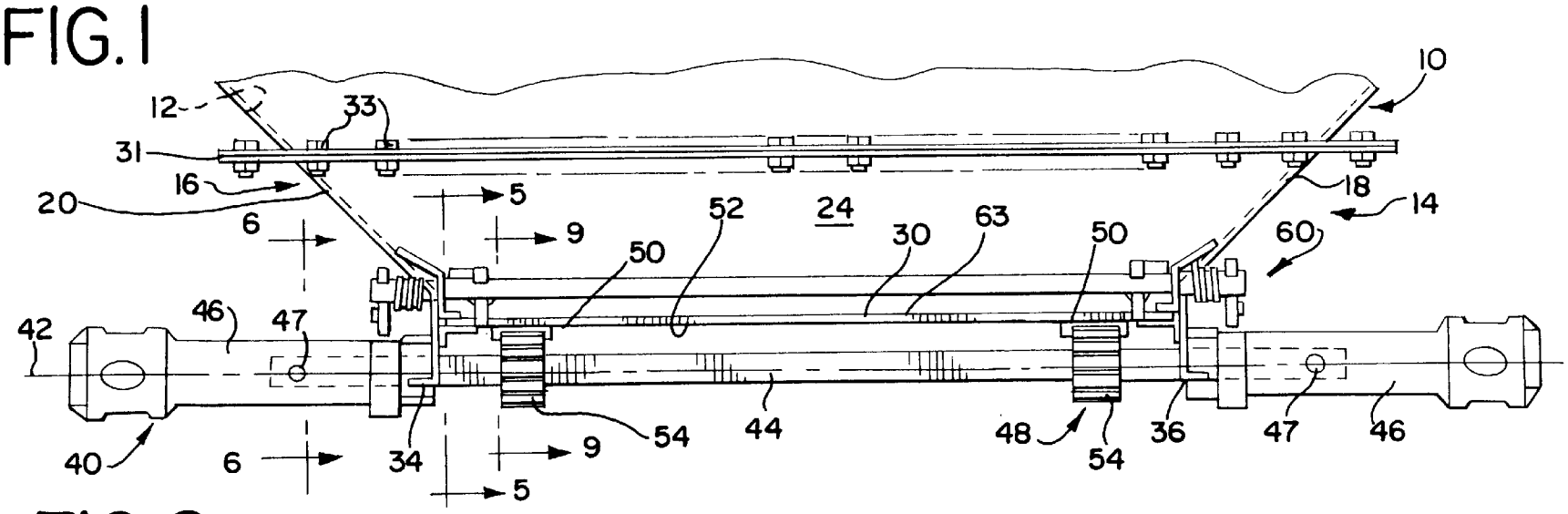
FIG. 1 is a rear elevational view of a railway hopper car discharge gate assembly embodying features of the present invention shown attached to a hopper car.

While the present invention is susceptible of embodiment in various forms, there is shown in the drawings a preferred embodiment hereinafter described with the understanding that the present disclosure is to be considered as an exemplification of the invention, and is not intended to limit the invention to the specific embodiment illustrated.

Referring now to the drawings, wherein like reference numerals refer to like parts throughout the several views, there is schematically illustrated in FIG. 1 a railway hopper car generally indicated by reference numeral 10. As will be appreciated, and as is conventional, the railway hopper car 10 is illustrated as including an outlet 12. It would be appreciated by those skilled in the art, however, that a railway hopper car typically has more than one outlet provided thereon. Since the outlets are all substantially similar, however, only one outlet 12 is shown for purposes of this description. Suffice it to say, the outlet 12 is arranged at the lower end of a conventional hopper section of a railway hopper car.

Figure 2:
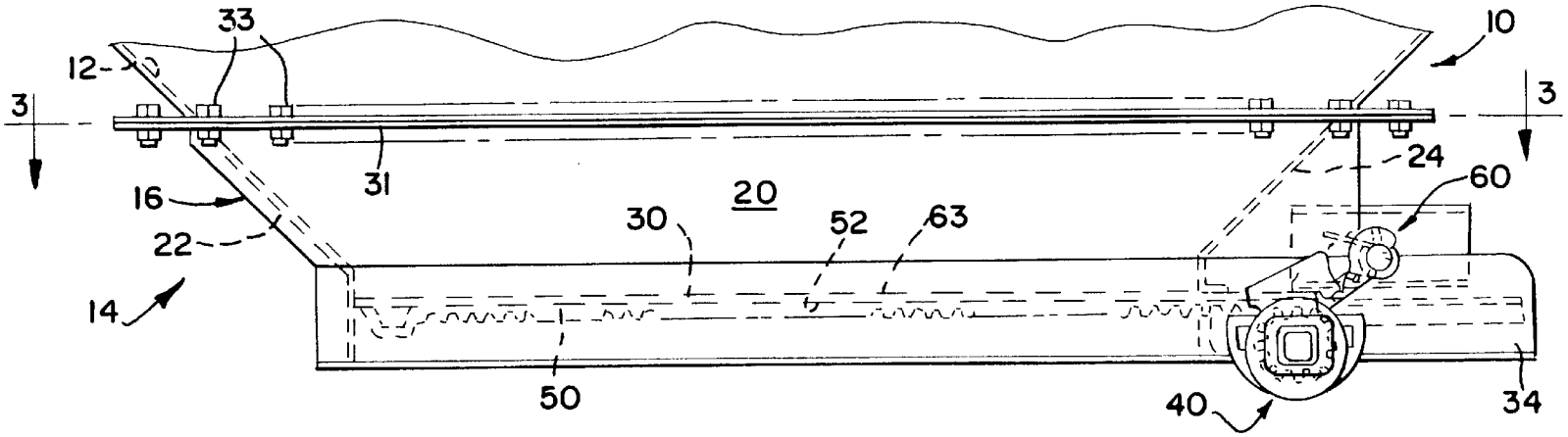
FIG. 2 is a side elevational view of the discharge gate assembly shown in FIG. 1.
Figure 3:
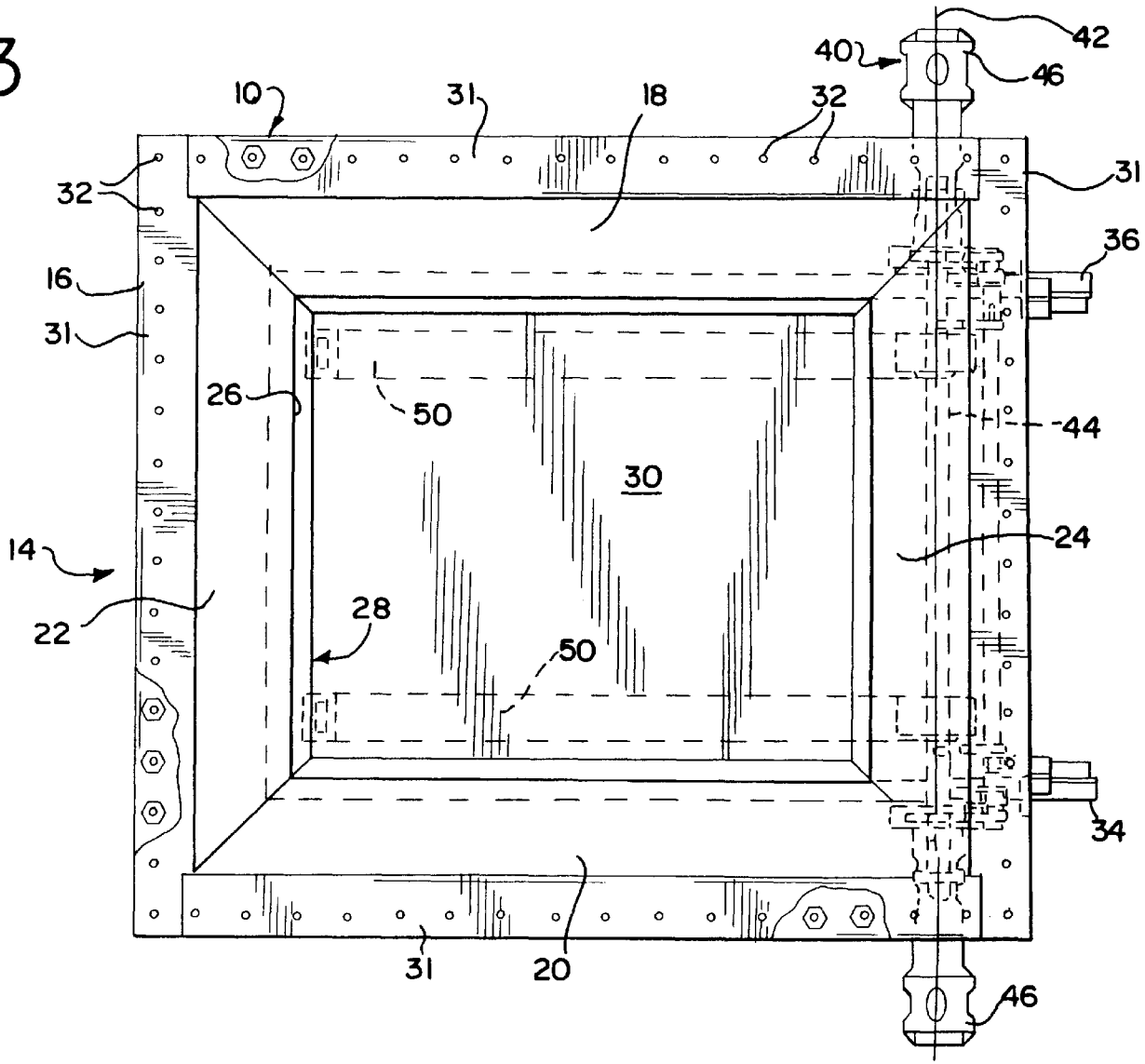
FIG. 3 is a plan elevational view taken along line 3—3 of FIG. 2.

To control the discharge of ballast or lading from the outlet 12, a discharge gate assembly 14 is arranged in combination with each outlet 12. The gate assembly 14 includes a rigid frame 16 formed of respective opposed sides 18, 20 and opposed end walls 22 and 24 which define a trapezoidal or rectangular discharge opening 26 (FIG. 3) therebetween. In the illustrated embodiment, the opposed sides 18, 20 extend lengthwise of the railway car 10 while the end walls 22, 24 extend transversely of the railway car 10. Toward their lower ends, the sides 18, 20 and end walls 22, 24 each define a common support structure 28 upon which a door or gate 30 is mounted for movement between opened and closed positions. In the illustrated form of the invention, each side 18, 20 and end wall 22, 24 has a horizontally extending flange 31 formed at its upper end. As shown in FIGS. 1 through 3, the flange 31 is configured to mate with respective portions of the outlet 12 on the hopper car to facilitate securement of the gate assembly 14 to the hopper car 10. In one form of the invention, the flanges 31 have spaced bolt holes 32 for facilitating the passage of suitable fasteners 33 (FIGS. 1 and 2) therethrough.

The support structure 28 slidably accommodates peripheral edges of the gate 30 and defines a path of movement for the gate 30 between open and closed positions thereof. In the illustrated embodiment, the gate 30 has a generally horizontal and rectangular configuration which is slidable across the discharge opening 26 defined by frame 16 to close same and is movable to a second or open position away from the discharge opening 26 defined by frame 16 to allow ballast or lading within the car 10 to be gravitationally exhausted therefrom.

Projecting away from the end wall 24 and extending lengthwise of the railway car 10, frame 16 of gate assembly 14 further includes generally parallel frame extensions 34 and 36. The frame extensions 34 and 36 support the gate 30 when it is moved to an open position.

As shown in FIGS. 1 and 3, the gate assembly 14 further includes a manually actuated operating shaft assembly 40 supported for rotation on the opposed frame extensions 34 and 36 for movement about a fixed axis 42. The operating shaft assembly 40 is operably coupled or connected to the gate 30 such that gate 30 moves relative to the frame 16 in response to rotation of the operating shaft assembly 40.

As shown in FIG. 1, the operating shaft assembly 40 extends transversely across the longitudinal axis of the hopper car 10 and beneath the gate 30. As is conventional, the operating shaft assembly 40 includes an elongated operating shaft 44 having operating handles or capstans 46 connected to opposite ends thereof. As is well know in the art, the operating handles or capstans 46 serve to rotatably mount the operating shaft 44 to the frame extensions 34, 36 of frame 16. In the illustrated embodiment of the discharge gate assembly 14, suitable fasteners 47 releasably interconnect each operating handle 46 to the operating shaft 44.

The operating shaft assembly 40 is operably coupled to the gate 30 through a rack and pinion assembly 48. The rack and pinion assembly 48 includes a pair of laterally spaced racks 50 which are fixed to an underside 52 of gate 30. A pair of pinion gears 54 are slidably received about the operating shaft 44 and have a meshing engagement with the rack members 50. Thus, the racks 50 are simultaneously moved in timed relation relative to each other by the pinion gears 54.

Movement of the gate 30 from a closed position toward an open position along its fixed path of movement is influenced by a lock assembly 60. The purpose of lock assembly is to hold the gate 30 against movement toward an open position until the lock assembly 60 is released by the operator. With the present invention, the lock assembly 60 is configured such that it is initially released in response to operation of the operating shaft assembly 40 automatically followed by movement of the gate 30 toward an open position. That is, with the present invention, the unlatching of the lock assembly 60 and opening of the gate 30 are affected in sequential order relative to each other and in response to rotation of the operating shaft assembly 40.

Figure 4:
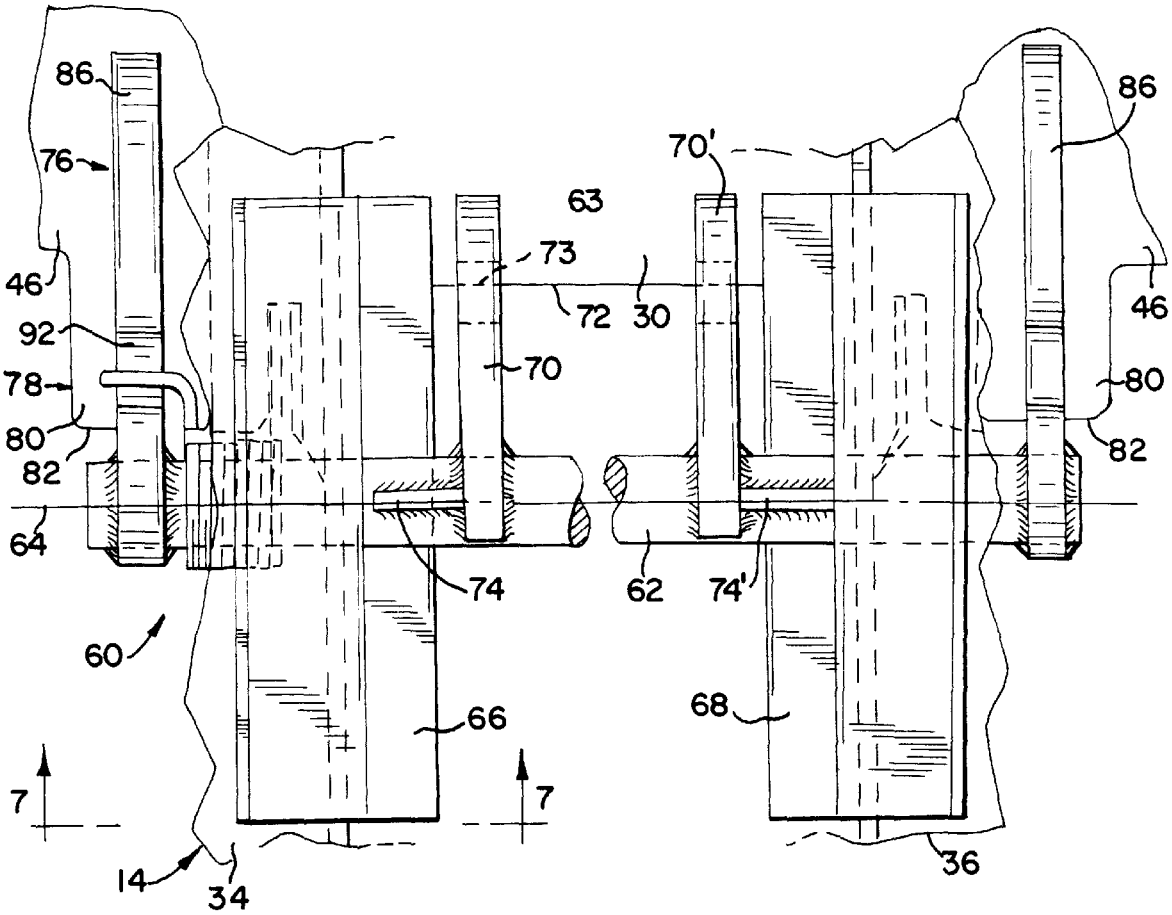
FIG. 4 is a fragmentary top plan view of the lock assembly of the present invention.

Turning now to FIG. 4, lock assembly 60 is shown as a separate subassembly which, preferably, is fabricated independent of the frame 16 and subsequently added thereto. As shown, lock assembly 60 includes a rockshaft 62 which, when the lock assembly 60 is mounted on the frame 16 of the gate assembly 14, is arranged above an upper side 63 (FIG. 2) of gate 30 and generally parallel thereto. Rockshaft 62 is operably independent of the operating shaft assembly 40 and is mounted for rotation about a fixed axis 64 extending generally parallel to the operating shaft assembly 40. In the illustrated form of the invention, a pair of brackets 66 and 68 rotatably mount the rockshaft 62 for oscillatory movement about axis 64.

When the lock assembly 60 is mounted to the frame 16, the brackets 66 and 68 are fixedly secured as by welding or other suitable techniques to the frame extensions 34 and 36, respectively, of the frame 16. Notably, when the subassembly of the lock assembly 60 is secured to the frame 16 of the gate assembly 14, the rockshaft 62 is disposed in a fore-and-aft relationship relative to the operating shaft assembly 40. That is, the rockshaft 62 is spaced above and lengthwise from the operating shaft assembly 40 in the direction that the gate 30 is to be opened.

Figure 5:
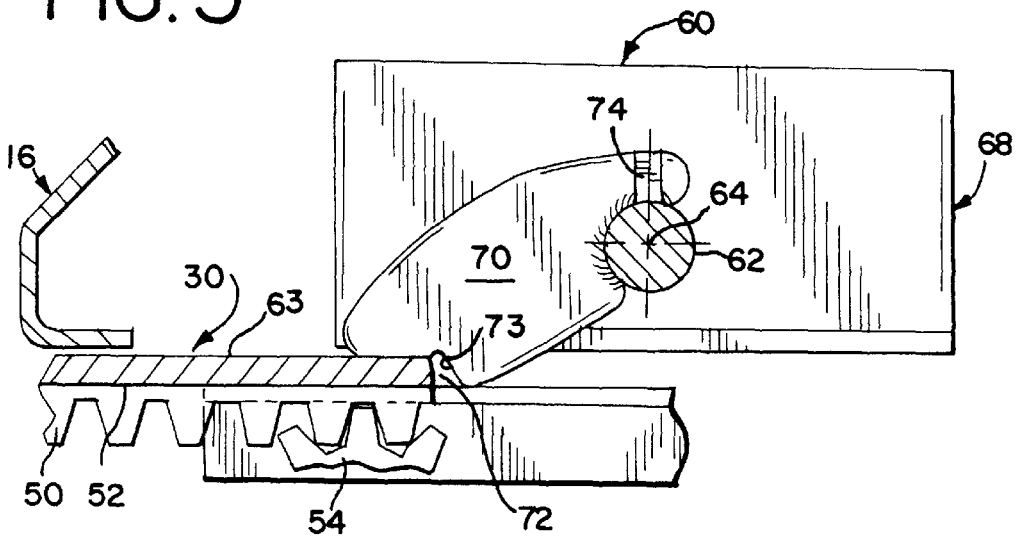
FIG. 5 is a fragmentary side elevation view taken along line 5—5 of FIG. 1.

Lock assembly 60 further includes a vertically displacable stop member 70 secured to and depending angularly downwardly from the rockshaft 62 into the path of travel of the door or gate 30. As shown in FIG. 5, a free end of the stop member 70 extends toward and into positive engagement with a gate edge 72 thereby preventing substantial movement of the gate 30 toward an open position. In a most preferred form of the invention, stop member 70 is configured with a notch or recess 73 for engaging edge 72 of gate 30 while preventing movement of the stop member 70 therepast. Preferably, the operative distance separating the notch 73 from the axis 64 of rockshaft 62 is greater than the distance separating the axis 64 of rockshaft 62 from the upper side 63 of the gate 30. Accordingly, when the stop member 70 engages the gate 30 a wedging action is created. Returning to FIG. 4, a spacer 74 is interposed between the stop member 70 and bracket 66 to limit axial movement of shaft 62 to the left as shown in FIG. 4.

A preferred form of lock assembly 60 further includes a second stop member 70' arranged in laterally spaced relation from the stop member 70. The stop member 70' is substantially similar to stop member 70 and thus, no further detailed description need be provided for proper understanding of same. Suffice it to say, a spacer 74' extends between stop member 70' and bracket 36 thereby limiting axial movement of rockshaft 62 to the right as shown in FIG. 4.

To affect operation of the lock assembly 60 in timed relation relative to the operating shaft assembly 40, the lock assembly 60 further includes a drive mechanism 76. Notably, the drive mechanism 76 for lock assembly 60 is disposed adjacent the frame extensions 34, 36 for positively displacing each stop member 70, 70' of the lock assembly 60 from the path of movement of the gate 30 upon rotation of the operating shaft assembly 40 and prior to movement of the gate 30 toward an open position.

In the illustrated embodiment, drive mechanism 76 includes cam structure 78 for positively displacing each stop member 70, 70' of the lock assembly 60 relative to the path of movement of the gate 30 upon rotation of the operating shaft assembly 40. Cam structure 78 includes an actuating member or cam 80 at each end of the operating shaft assembly 40. Since the actuating members or cams 80 at opposite ends of the operating shaft assembly 40 are identical relative to each other, only one actuating member or cam 80 will be described in detail with the understanding that the other actuating member or cam 80 is substantially identical thereto.

As shown, each actuating member or cam 80 is preferably formed as part of each operating handle 46 and includes a peripheral surface 82. Notably, at least a portion of each actuating cam 80 is larger in diameter and extends radially outward from that portion of the operating handle 46 joined thereto. For purposes to be described hereinafter, each actuating member or cam 80 defines a throughbore or slot 84 in radially spaced relation relative to the rotational axis 42 of the operating shaft assembly 40. In a preferred form of the invention, a corresponding slot 84' is defined by the cam or actuator 80 on the opposite side of the rotational axis of the operating shaft assembly 40. Accordingly, the operating handles 46 are interchangeable relative to each other.

Figure 6:
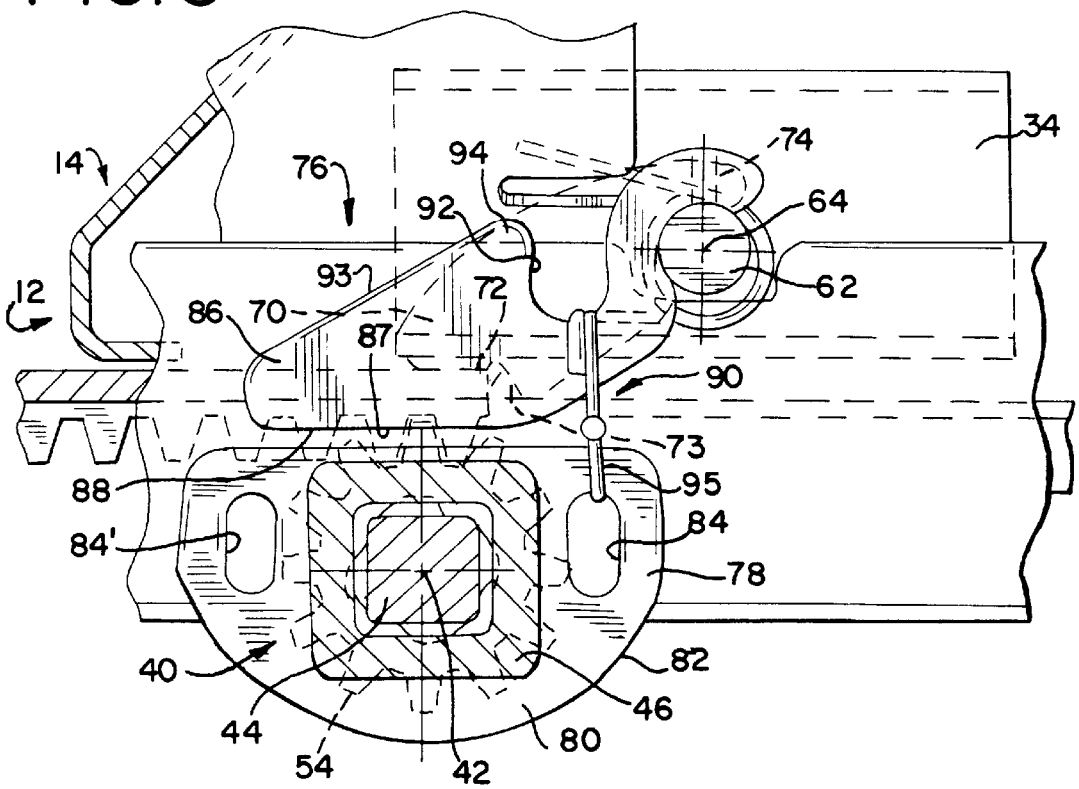
FIG. 6 is a fragmentary side elevational view taken along line 6—6 of FIG. 1.

As shown, drive mechanism 76 further includes a cam follower 86 operably associated with each actuating member or cam 80. One end of each cam follower 86 is fixedly secured as by welding or the like to the rockshaft 62 on an outer side of a respective mounting bracket 34, 36. Mounting the cam followers 86 outside of the mounting brackets 34, 36 increases the possible throw or movement of the lock assembly 60 and, thus, makes the lock subassembly 60 more tolerant to dimensional differences thereby promoting manufacture of the gate assembly 14 because of its simplicity. As shown in FIGS. 4 and 6, each follower 86 of the drive mechanism 76 extends radially outwardly from its attachment to the rockshaft 62 and overlies a respective operating cam or actuator 80. Along its underside 87, each cam follower 86 includes a cam engaging surface 88 specifically configured and designed to prevent the follower 86 from binding against the peripheral surface 82 of the cam or actuator 80.

Intermediate its ends, each cam follower 86 is configured to promote arrangement of a railcar seal 90 in only one position of the lock assembly 60. In the illustrated embodiment of the invention, a channel or slot 92 depends from and opens to an upper side 93 of each follower 86. Notably, the channel or slot 92 defines a lobe 94 toward an upper side thereof. The lobed configuration 94 on each follower 86 preferably serves a dual purpose. First, lobe 94 is configured to limit arcuate movement of the follower 96 about the axis 64 of rockshaft 62 and relative to frame 14 of the gate assembly 12. Moreover, the lobed configuration 94 on each follower 86 is specifically designed to prevent the car seal 90 from being incorrectly arranged between the follower 86 and the cam actuator 80. As will be appreciated by those skilled in the art, the car seal 90 comprises a ribbon-like member 95 that passes through the throughbore or slot 84 in the cam or actuator 80 and is entrapped within the channel 92 with opposite ends of the seal 90 being secured to each other to provide a visual indication of railcar tampering.

Figure 7:
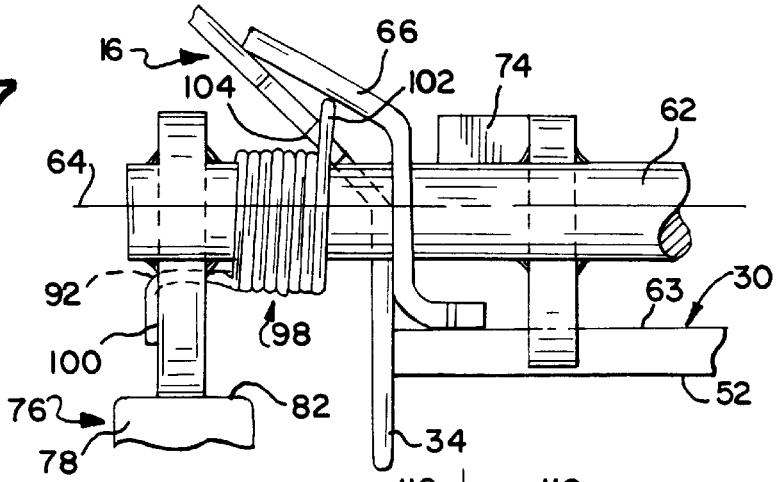
FIG. 7 is a fragmentary view taken along line 7—7 of FIG. 4.

Turning to FIG. 7, each cam follower 86 is urged into operable engagement with the peripheral surface 82 of a respective cam or actuating member 80. As will be appreciated, each cam follower 86 is gravitationally urged into engagement with the peripheral surface 82 of a respective actuating member or cam 80. In the illustrated form of the invention, a torsion spring 98 serves to resiliently urge each cam follower 86 into positive engagement with a respective cam or actuating member 80. As shown, one leg 100 of spring 98 is captively entrapped in the open channel 92 of a respective follower 86. The other leg 102 of spring 98 passes through an opening or slot 104 defined by an adjacent frame extension 34, 36 and captively impinges against a respective mounting bracket 66, 68 to develop the necessary level of spring torsion for positively and constantly urging the follower 86 into operable engagement with the peripheral surface 82 of a respective actuating member or cam 80.

The drive system 76 for operating the lock assembly 60 further embodies a lost motion mechanism arranged between the operating shaft assembly 40 and the gate 30 for effecting sequential movement of the lock assembly 60 and the gate 30 in predetermined relation relative to each other. The purpose of the lost motion mechanism inherent with the drive mechanism 76 of lock assembly 60 is to permit the operating shaft assembly 40 to be rotated about an angle of free rotation. As used herein, the term "free rotation" refers to that rotation of the operating shaft assembly 40 suitable to remove or disengage the lock assembly 60 from the path of travel of the gate 30 prior to effecting linear displacement of the gate 30 toward an open position.

Figure 8:
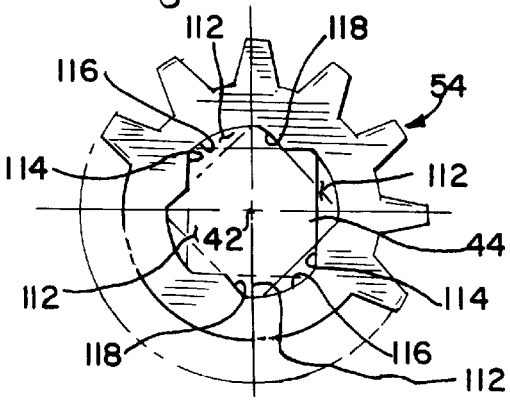
FIG. 8 is a schematic elevational view of a pinion gear forming part of the present invention.

Notably, in the illustrated embodiment, the elongated operating shaft 44 of operating shaft assembly 40 has a generally square cross-sectional configuration. In the illustrated embodiment, the lost motion mechanism involves configuring each pinion gear 54 of the rack and pinion assembly 48 with a slotted configuration 110 specifically related to the cross-sectional configuration of the operating shaft 44 of operating shaft assembly 40. As shown in FIG. 8, the slotted configuration 110 in each pinion gear 54 has a duodecimal surface configuration which is preferably centered upon the rotational axis 42 of the operating shaft assembly 40 and defines a rotary path for the operating shaft 44 relative to each pinion gear 54.

The slotted configuration 110 in each pinion 54 preferably includes four equally spaced recesses 112 which are joined to each other and which are equally disposed about the rotational axis 42 of the operating shaft assembly 40. Each recess 112 is defined by first, second and third walls or surfaces 114, 116 and 118, respectively. The wall or surface 114 of each recess 112 defines the limit of rotation of the shaft 44 relative to other portions of the operating shaft assembly 40. The wall or surface 116 of each recess 112 has a curvilinear configuration and a radius equal to one-half of the distance between diametrically opposed corners of the operating shaft 44. The wall or surface 118 of each recess 112 on the pinions 54 defines the limit of free rotational travel of the operating shaft 44 relative to the pinions 54. As will be appreciated, if the cross-section of configuration of the operating shaft 44 of operating shaft assembly 40 were other than square, the slotted configuration 110 defined by each pinion gear 54 may likewise be altered to accommodate a predetermined angle of free rotation of the operating shaft 44.

Operation of the gate 30 and lock assembly 60 is such that when the gate 30 is in a closed position, each stop member 70, 70' of the lock assembly 60 is in positive engagement with the gate 30, and the operating shaft 44 is disposed relative to the slotted configuration 110 in each pinion gear 54 substantially as shown in FIG. 9. The gate 30 is locked in its closed position at this time. With the gate 30 in the closed position shown in FIG. 9, the outer surface of the operating shaft 44 extends generally parallel to and likely engages the walls or surfaces 114 of each recess 112 of the slotted configuration 110 in each pinion 54.

When the gate 30 is to be opened, a suitable tool or powered driver (not shown) operably engages with and is operated to turn or rotate the operating shaft assembly 40 in the appropriate direction. In the embodiment illustrated in FIGS. 10 and 11, the operating shaft assembly is shown being turned in a clockwise direction to open the gate 30. In the illustrated embodiment of the invention, turning of the operating shaft assembly 40 causes rotation of both operating handles 46 connected to each other through the operating shaft 44 which, in the illustrated embodiment, also turns when rotation is imparted to the operating shaft assembly 40. As will be appreciated, and as shown in FIG. 11, turning of the operating handles 46 likewise results in rotation of the actuating members or cams 80 of the cam structure 78 thus breaking the seal 95.

As will be appreciated, during the initial rotational or turning movement of the operating shaft assembly 40, the cam structure 78 forcibly and positively displaces the cam followers 86 against the action of spring 90 resulting in rotation of the rockshaft 62 in a clockwise direction as seen in FIGS. 10 and 11. Rotation of the rockshaft 62 in a clockwise direction as shown in FIGS. 10 and 11 likewise causes vertical displacement of each stop member 70, 70' of the lock assembly 60 thus removing each stop member 70, 70' from the path of movement of the gate 30.

As shown in FIG. 11, during the initial rotational movement of the operating shaft assembly 40, the outer surface of operating shaft 44 turns through the slotted configuration 110 provided in each pinion 54 thus no rotation or movement is imparted to the gate 30 during the initial turning movement of the operating shaft assembly 40. In the illustrated embodiment of the invention, the operating shaft assembly 40 freely turns through a range of movement measuring about 35° to about 55° of initial movement of the operating shaft assembly 40. In a most preferred form of the invention, the operating shaft assembly 40 turns or rotates through a range of movement measuring about 45° of initial movement of the operating shaft assembly 40. As such, the lock assembly 60 is fully released from its positive engagement with the gate 30 prior to movement of the gate 30 toward an open position.

At the limit of free rotational movement of the operating shaft assembly 40, the outer surface of the operating shaft 44 is disposed as shown in FIG. 11 within the slotted configuration 110 of each pinion 54. As such, the outer surface of the operating shaft 44 extends generally parallel to and likely engages the walls or surfaces 118 of the slotted configuration 110 on each pinion 54.

Figure 12:
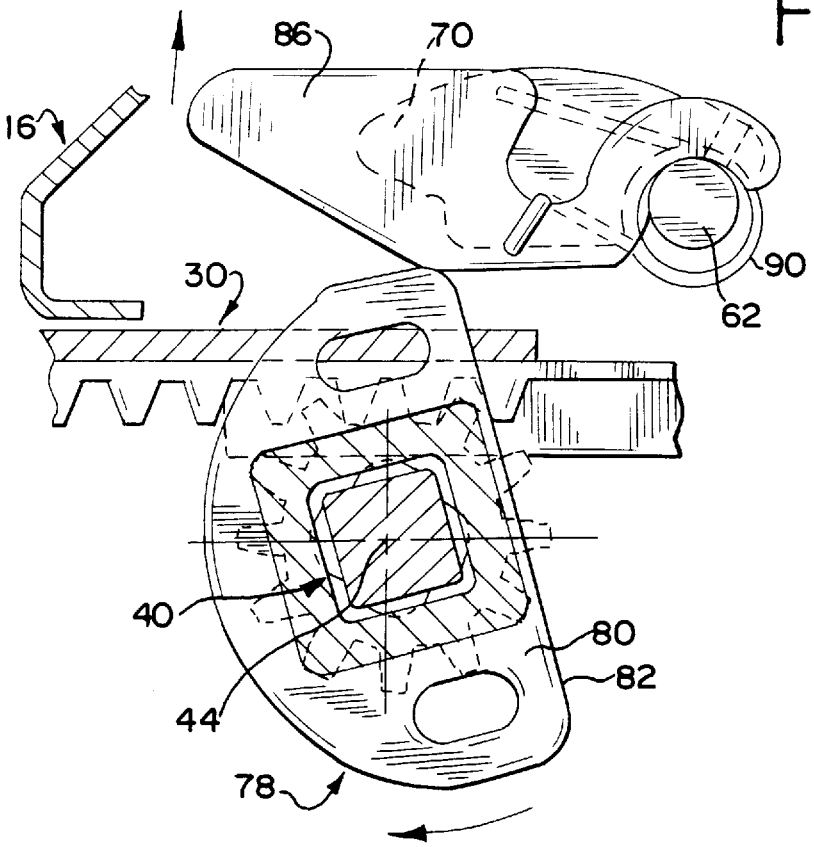
FIG. 12 is a side elevational view similar to FIG. 10 but showing further rotation of the operating shaft assembly.
Figure 13:
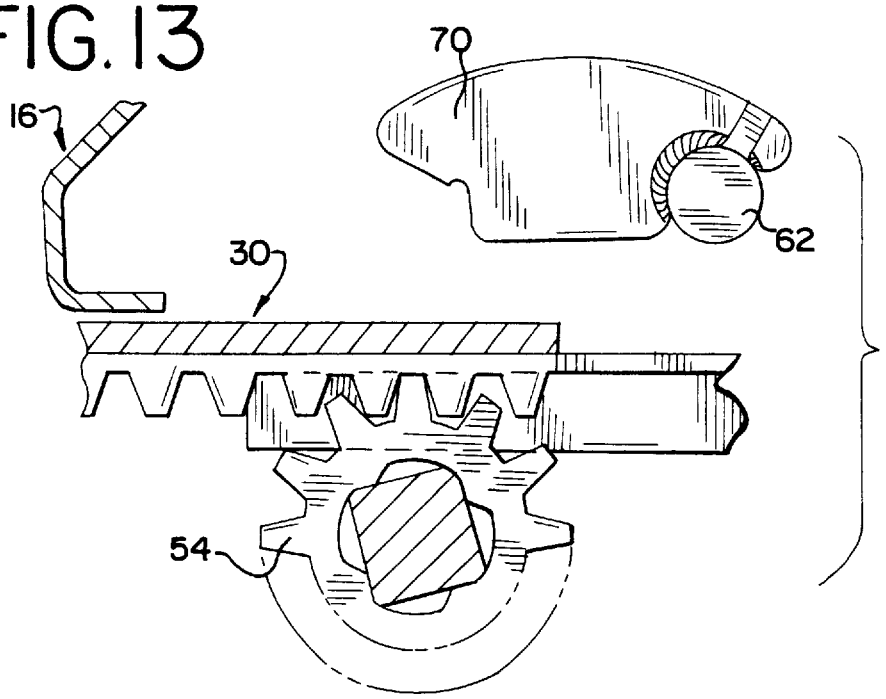
FIG. 13 is a view similar to FIG. 11 but showing the relationship of the parts or components of the present invention when the operating shaft assembly is in the position shown in FIG. 12.

As will be appreciated, and as shown in FIG. 12, further rotation of the operating shaft assembly 40 in a clockwise direction will cause the actuating members or cams 80 of cam structure 78 to further displace or move the stop member 70 against the action of spring 90. It should be appreciated that the peripheral surface 82 of each cam 80 is configured to position and hold or maintain the stop members 70, 70' of the lock assembly 60 out of engagement with the door 30 while concomitantly resulting in rotation of the pinion gears 54, and, thus, movement of the gate 30 toward an open position. That is, once the free rotational movement of the operating shaft assembly 40 is traversed, continued rotation of the operating shaft assembly 40 causes the pinions 54 of the rack and pinion assembly 48 to rotate in unison thus linearly displacing the gate 30 along its predetermined path of movement and relative to frame 16.

When the ballast or lading is fully discharged from the hopper car 10, the operating shaft assembly 40 is turned in the opposite direction to close the gate 30. When rotation of the operating shaft assembly 40 is reversed, there will be a predetermined free rotational movement of the operating shaft assembly 40 until the outer surface of the operating shaft 44 engages surfaces 114 of the recesses 112 defmed by the slotted configuration 110 on each pinion gear 54. Continued rotation of the operating shaft assembly 40 imparts rotation to the pinions 54 of the rack and pinion assembly 48 thus causing the gate 30 to move toward a closed position. When the gate 30 reaches its closed position, each actuating member or cam 80 of the cam structure 78 is disposed as shown in FIG. 6. Accordingly, the effects of gravitation and spring 98 urge the stop member 70 into the position shown in FIG. 5 thus locking the gate 30 in its closed position.

Providing a lost motion mechanism in combination with the lock assembly 60 allows a desired sequence of operations to be effected, i.e., removing the stop members 70 of the lock assembly 60 from the path of travel or movement of the gate 30 thereby initially unlocking lock assembly 60 immediately followed by opening of the gate 30. Further, this sequence occurs automatically without requiring manual manipulation of both the lock and the gate opening mechanism. In contrast to prior art devices, the operator merely needs to turn or operate the operating shaft assembly 40 thereby effecting both unlocking of the lock assembly 60 and opening of the gate 30 in sequential order relative to each other while eliminating the manual task and effort of having to initially condition the lock assembly out of the path of travel or movement of the gate. As will be appreciated from an understanding of the present invention, the lost motion mechanism prevents immediate opening of the gate 30 and provides a predetermined gate opening delay following initial turning movement of the operating shaft assembly 40.

The preferred design of the present invention i.e., mounting the stop members 70, 70' of the lock assembly 60 in fore-and-aft spaced relation relative to the operating shaft assembly advantageously provides a positive locking feature because the stop members 70, 70' of the lock assembly 60 are driven into positive engagement with the gate 30 thereby preventing the gate 30 from inadvertently moving toward an open position. Moreover, the wedged design of the stop members 70, 70' relative to the gate 30 serves to enhance the locking effectiveness of the lock assembly 60 in response to movement of the gate 30 toward an open position prior to release of the locking assembly 60.

Separately or independently mounting the lock assembly 60 relative to the operating shaft assembly 40 also yields several advantages. First, fabrication of the gate assembly 14 is enhanced. Second, the torque influences imparted to the operating shaft assembly 40 to open the gate 30, notwithstanding the extreme vertical loading placed thereon, have little or no effect on operation of the lock assembly 60.

Mounting the lock assembly 60 on an upper side of the gate 30 enhances visual access to engagement of the stop members 70, 70' relative to the gate. Mounting the lock assembly 60 on an upper side of the gate 30 moreover advantageously reduces the likelihood that commodities will interfere with operation of the lock assembly. Mounting the drive mechanism 76 for the lock assembly 60 adjacent the frame extensions 34 and 36 of the gate assembly 14 advantageously allows an increased torque input to the operating shaft assembly 40 without detrimental effects to operation of the lock assembly. Additionally, arranging the lock assembly 60 above and in spaced relation relative to the operating shaft assembly 40, reduces the overall length of the gate 30. As will be appreciated by those skilled in the art, reducing the overall length of the gate 30 yields several advantages. First, it reduces the weight of the gate 30. Moreover, it reduces the amount of material required for the gate 30 and thus, reduces manufacturing costs of the gate assembly 14. Suffice it to say, the overall design of the gate assembly of the present invention meets AAR standards concerning gravity outlet designs. Furthermore, the gate assembly of the present invention is usable both as original equipment on a railcar and as retrofittably assembly.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the spirit and scope of the claims.

What is claimed:

1. A railway hopper car discharge gate assembly comprising:

a frame defining a generally rectangular discharge opening with a gate slidably mounted on said frame for endwise horizontal movement between open and closed positions along a predetermined path of movement for controlling discharge of ballast from a railway hopper car to which said gate assembly is to be mounted;

an operating shaft assembly supported on opposed frame extensions for rotational movement about a fixed axis, said operating shaft assembly being operably coupled to said gate; and a lock assembly including a vertically displacable stop member mounted for vertical and rotational movement about a fixed axis extending above the path of travel of said gate and rearwardly of a rearward edge thereof and which, when said gate is in its closed position, extends downwardly toward and into positive engagement with said gate edge thereby preventing substantial movement of said gate toward the open position, and a drive mechanism disposed adjacent the frame extensions for positively displacing said stop member from the path of travel of the gate upon rotation of said operating shaft assembly prior to movement of said gate toward the open position.

2. The gate assembly according to claim 1 wherein said operating shaft assembly is operably connected to said gate through pinions mounted upon an operating shaft, with said pinions being arranged in intermeshing relation with racks fitted to an underside of said gate.

3. The gate assembly according to claim 2 wherein said stop member is mounted upon a shaft extending generally parallel to and above an upper side of said gate to enhance visualization of the relationship between said stop member and the gate.

4. The gate assembly according to claim 1 wherein said stop member is urged into releasable engagement with said edge of said gate.

5. The gate assembly according to claim 1 wherein said drive mechanism includes cam structure at opposite ends of said operating shaft assembly for positively displacing said stop member relative to the path of movement of the gate upon rotation of said operating shaft assembly.

6. The gate assembly according to claim 1 wherein said drive mechanism includes cam structure disposed adjacent said frame extensions to minimize the effect high torque requirements of said operating shaft assembly have on operation of said lock assembly.

7. The gate assembly according to claim 1 further including a lost motion mechanism arranged between said operating shaft assembly and said gate for effecting sequential movement of said stop member and said gate in predetermined relation relative to each other.

8. The gate assembly according to claim 1 further including a sealing member disposed between said lock assembly and said operating shaft assembly for providing a visual reference regarding operation of said gate.

9. A railway hopper car discharge gate assembly comprising:

a rigid frame defining a generally rectangular discharge opening and supports upon which a gate is slidably mounted for endwise horizontal movement between open and closed positions along a predetermined path of movement for controlling discharge of ballast from a railway hopper car to which said gate assembly is to be mounted;

an operating shaft assembly supported on opposed frame extensions for rotational movement about a fixed axis, said operating shaft assembly being operably connected to said gate such that said gate moves relative to said frame in response to rotation of said operating shaft assembly; and a lock assembly operably coupled to said operating shaft assembly, said lock assembly including a vertically displacable stop member mounted for movement about a pivot axis disposed at an elevation farther above said supports than is said gate and which, when said gate is in the closed position, extends downwardly and forwardly relative to said pivot axis into the path of movement and into engagement with said gate thereby preventing substantial movement of the gate toward the open position, and wherein a drive mechanism arranged adjacent the frame extensions operates said stop member in timed relation relative to said operating shaft assembly such that said stop member is removed from the path of movement and out of engagement with said gate prior to movement of the gate toward the open position.

10. The gate assembly according to claim 9 wherein said operating shaft assembly is operably connected to said gate through a rack and pinion assembly arranged beneath the predetermined path of movement of said gate.

11. The gate assembly according to claim 10 further including a lost motion mechanism arranged between said operating shaft assembly and said gate for effecting sequential movement of said stop member and said gate.

12. The gate assembly according to claim 11 wherein said operating shaft assembly comprises an elongated operating shaft supported at opposite ends by operating handles connected to said shaft.

13. The gate assembly according to claim 12 wherein said lost motion mechanism includes a slotted configuration arranged on pinions of said rack and pinion assembly.

14. The gate assembly according to claim 9 wherein the axis about which said stop member moves is defined by a shaft extending parallel to and above said gate to enhance visual access to the lock assembly and the relationship thereof to the gate.

15. The gate assembly according to claim 9 further including a spring mechanism for urging said stop member into engagement with an edge of said gate.

16. The gate assembly according to claim 9 wherein said drive mechanism includes cams disposed adjacent said frame extensions to minimize the effect high torque requirements of said operating shaft assembly have on operation of said lock assembly.

17. The gate assembly according to claim 16 wherein said stop member is connected to a rockshaft extending parallel to and above said gate, said rockshaft having cam followers at opposite ends thereof for engaging a periphery of said cams and thereby positively moving said stop member regardless of the torque input to said operating shaft assembly.

18. The gate assembly according to claim 9 further including a lost motion mechanism arranged between said operating shaft assembly and said gate for effecting sequential movement of said stop member and said gate in predetermined relation relative to each other.

19. The gate assembly according to claim 9 further including a sealing member disposed between said lock assembly and said operating shaft assembly for providing a visual reference regarding operation of said gate.

20. A railway hopper car discharge gate assembly comprising:

a rigid frame defining a generally rectangular discharge opening and supports upon which a gate is slidably mounted for endwise horizontal movement between open and closed positions along a predetermined path of movement for controlling discharge of ballast from a railway hopper car to which said gate assembly is to be mounted;

an operating shaft assembly supported on opposed frame extensions for rotational movement about a fixed axis, said operating shaft assembly being operably connected to said gate through a rack and pinion assembly arranged beneath the predetermined path of movement of said gate whereby said gate moves relative to said frame in response to rotation of said operating shaft assembly, and wherein said operating shaft assembly comprises an elongated operating shaft supported at opposite ends by operating handles connected to said shaft;

a lock assembly operably coupled to said operating assembly, said lock assembly including a vertically displacable stop member mounted for movement about a pivot axis disposed at an elevation farther above said supports than is said gate and which, when said gate is in the closed position, extends downwardly and forwardly relative to said pivot axis into the path of movement and into engagement with said gate thereby preventing substantial movement of the gate toward the open position, and wherein a drive mechanism arranged adjacent the frame extensions operates said stop member in timed relation relative to said operating shaft such that said stop is removed from the path of movement and out of engagement with said gate prior to movement of the gate toward the open position; and wherein a lost motion mechanism is disposed between said elongated operating shaft and pinions of said rack and pinion assembly mounted in laterally spaced relation along the operating shaft for effecting sequential movement of the stop member and said gate upon rotation of the operating shaft assembly.

21. A railway hopper car discharge gate assembly comprising:

a rigid frame defining a generally rectangular discharge opening and supports upon which a gate is slidably mounted for endwise horizontal movement between open and closed positions along a predetermined path of movement for controlling discharge of ballast from a railway hopper car to which said gate assembly is to be mounted;

an operating shaft assembly supported on opposed frame extensions for rotational movement about a fixed axis, said operating shaft assembly being operably connected to said gate such that said gate moves relative to said frame in response to rotation of said operating shaft assembly, and wherein said operating shaft assembly comprises a pair of operating handles at opposite ends of said shaft assembly for rotatably supporting an operating shaft across and parallel to an end of said gate, and wherein said operating shaft has a pair of pinions mounted in spaced relation along the length thereof in operable engagement with racks secured to an underside of said gate;

a lock assembly operably coupled to said operating assembly, said lock assembly including a vertically displacable stop member mounted for movement about a pivot axis disposed at an elevation farther above said supports than is said gate and which, when said gate is in the closed position, extends downwardly and forwardly relative to said pivot axis into the path of movement and into engagement with said gate thereby preventing substantial movement of the gate toward the open position, and wherein a drive mechanism arranged adjacent the frame extensions operates said stop member in timed relation relative to said operating shaft such that said stop is removed from the path of movement and out of engagement with said gate prior to movement of the gate toward the open position; and wherein a lost motion mechanism is provided inbetween said pinions and the operating shaft for effecting sequential movement of the stop member and said gate in predetermined relation relative to each other.

22. A railway hopper car discharge gate assembly comprising:

a frame defining a generally rectangular discharge opening with a gate slidably mounted on said frame for endwise horizontal movement between open and closed positions along a predetermined path of movement for controlling discharge of ballast from a railway hopper car to which said gate assembly is to be mounted;

an operator controlled actuation assembly for moving said gate along its predetermined path of movement between the open and closed positions, said actuation assembly including an elongated shaft mounted on opposed frame extensions for rotational movement about a fixed axis extending generally parallel to a rear edge of said gate, said shaft assembly being operably coupled to said gate; and a lock assembly including a vertically displacable stop member which, when said gate is in the closed position, extends downwardly into the path of movement and into engagement with said gate thereby preventing substantial horizontal movement of said gate toward the open position, said stop member being mounted on a rockshaft rotatable about a fixed axis extending above and generally parallel to an upper surface of the gate rearwardly of the fixed axis of said actuation assembly such that any deviation imparted to said actuation assembly in operating the gate has substantially no effect on operation of the lock assembly, said lock assembly further including a drive for operating said stop member in timed relation relative to movement of said gate, said drive including a lost motion mechanism for automatically effecting, in sequential order and in response to rotation of said actuation assembly, displacement of said stop member from the path of travel of the gate and movement of the gate toward the open position.

23. The gate assembly according to claim 22 wherein said lock assembly includes a second stop member carried on said rockshaft, each stop member being engagable with an edge of said gate thereby inhibiting substantial movement of said gate toward the open position.

24. The gate assembly according to claim 22 wherein said operator controlled actuation assembly further includes operating handles connected to opposed ends of and for mounting said elongated shaft for rotation about a fixed axis relative to said frame.

25. The gate assembly according to claim 22 further including a rack and pinion assembly for operably interconnecting said actuation assembly to said gate.

26. The gate assembly according to claim 24 wherein said drive for operating said stop member includes cam structure carried by said operating handles and followers connected to said rockshaft and responsive to rotation of said cam structures.

27. The gate assembly according to claim 26 further including a spring for urging each follower into engagement with a periphery of said cam structure.

28. The gate assembly according to claim 25 wherein said rack and pinion assembly includes a pair of laterally spaced pinions mounted on said operating shaft.

29. The gate assembly according to claim 22 further including a spring for urging said stop member into engagement with said gate.

30. A railway hopper car discharge gate assembly comprising:

a frame defining a generally rectangular discharge opening with a gate slidablv mounted on said frame for endwise horizontal movement between open and closed positions along a predetermined path of movement for controlling discharge of ballast from a railway hopper car to which said gate assembly is to be mounted;

an operator controlled actuation assembly for moving said gate along its predetermined path of movement between the open and closed positions, said actuation assembly being operably coupled to said gate through a rack and pinion assembly including pairs of racks and pinions, with said actuation assembly including an elongated shaft mounted on opposed frame extensions for rotational movement about a fixed axis extending generally parallel to a rear edge of the gate and having the pinions of said rack and pinion assembly mounted thereon in laterally spaced relation relative to each other; and a lock assembly including a vertically displacable stop member which, when said gate is in the closed position, extends downwardly into the path of movement and into engagement with said gate thereby preventing substantial horizontal movement of said gate toward the open position, said stop member being mounted on a rockshaft rotatable about a fixed axis extending above and generally parallel to an upper surface of the gate in fore-and-aft spaced relation from the fixed axis of said actuation assembly such that any deviation imparted to said actuation assembly in operating the gate has substantially no effect on operation of the lock assembly, said lock assembly further including a drive for operating said stop member in timed relation relative to movement of the gate, said drive including a lost motion mechanism for automatically effecting, in sequential order and in response to actuation of said actuation assembly, displacement of said stop member from the path of movement of the gate and movement of the gate toward an open position, and wherein said lost motion mechanism includes corresponding slotted configurations in said pinions such that said operating shaft freely rotates through a predetermined range of rotation before said gate begins to move toward the open position from the closed position.

31. The gate assembly according to claim 30 wherein said predetermined range of rotation is from about 35° to about 55° of initial movement of said actuation assembly.

32. The gate assembly according to claim 30 wherein said predetermined range of rotation is about 45° of initial movement of said actuation assembly.

33. A railway hopper car discharge gate assembly comprising:

a frame defining a generally rectangular discharge opening and including a pair of parallel and opposed frame extensions;

a gate mounted on the frame for sliding movement between open and closed positions for controlling discharge of ballast from a railway hopper car to which said gate assembly is to be mounted;

an operating shaft assembly including an elongated operating shaft mounted between said frame extensions for rotation about a fixed axis, said operating shaft assembly further including operating handles mounted to opposite ends of said operating shaft and extending outwardly from the respective frame extensions;

a rack and pinion assembly operably coupled to the operating shaft assembly for moving said gate between the open and closed positions in response to rotation of said operating shaft assembly;

a rotary lost motion mechanism arranged between the operating shaft and each pinion of said rack and pinion assembly;

a stop member movably mounted on the frame adjacent to the operating shaft and adjacent to one frame extension and which, when the gate is in a closed position, extends into the path of movement of the gate for preventing substantial movement of the gate toward an open position an actuating member movable by one of said operating handles; and an operative connection between the actuating member and the stop member whereby movement of one of the operating handles in a direction to move the gate toward an open position moves the actuating member during collapse of the rotary lost motion mechanism to positively move the stop member thereby allowing the gate to move toward the open position.

34. The discharge gate assembly according to claim 33 wherein said stop member is vertically displacable about a pivot axis disposed at an elevation above said gate and which, when said gate is in the closed position, extends downwardly and forwardly relative to said pivot axis into engagement with said gate.

35. The discharge gate assembly according to claim 33 further including a second stop member mounted on the frame adjacent to the operating shaft and adjacent the other frame extension and which, when the gate is in the closed position, extends into the path of movement of the gate thereby preventing substantial movement of the gate toward the open position.

36. The discharge gate assembly according to claim 35 wherein each stop member is mounted on a common shaft supported at opposite ends by said frame extensions, said shaft defining a fixed generally horizontal axis disposed generally parallel and adjacent the operating shaft.

37. The gate assembly according to claim 33 wherein said actuating member is configured to accommodate a seal for providing a visual reference regarding operation of said gate.

38. The gate assembly according to claim 33 further including a spring for resiliently urging said stop member into the path of movement of the gate.

39. The gate assembly according to claim 33 wherein at least a lengthwise portion of said operating shaft passing endwise through said pinions has a generally square cross-sectional configuration, and wherein said pinions define corresponding slotted configurations for allowing a predetermined range of free rotation of said operating shaft assembly before said gate begins to move toward the open position.

40. The gate assembly according to claim 39 wherein said predetermined range of free rotation is from about 35° to about 55° of initial movement of the operating shaft assembly.

* * * * *